US011270851B2

(12) United States Patent
Nishiguchi et al.

(10) Patent No.: US 11,270,851 B2
(45) Date of Patent: Mar. 8, 2022

(54) CONTACT DEVICE AND ELECTROMAGNETIC RELAY

(71) Applicants: DENSO CORPORATION, Kariya (JP); DENSO ELECTRONICS CORPORATION, Anjo (JP)

(72) Inventors: Yoshitaka Nishiguchi, Nisshin (JP); Takahiro Soki, Kariya (JP); Masanao Sugisawa, Anjo (JP); Kentaro Yamaguchi, Anjo (JP)

(73) Assignees: DENSO CORPORATION, Kariya (JP); DENSO ELECTRONICS CORPORATION, Anjo (JP)

( * ) Notice: Subject to any disclaimer, the term of this patent is extended or adjusted under 35 U.S.C. 154(b) by 280 days.

(21) Appl. No.: 16/427,955

(22) Filed: May 31, 2019

(65) Prior Publication Data

US 2020/0035433 A1 Jan. 30, 2020

(30) Foreign Application Priority Data

Jul. 24, 2018 (JP) ..... JP2018-138621

(51) Int. Cl.
*H01H 1/54* (2006.01)
*H01H 9/44* (2006.01)
*H01H 1/58* (2006.01)

(52) U.S. Cl.
CPC ..... *H01H 1/54* (2013.01); *H01H 9/443* (2013.01); *H01H 2001/5838* (2013.01)

(58) Field of Classification Search
CPC ..... H01H 1/54; H01H 2001/5838
USPC ..... 335/16, 147, 195
See application file for complete search history.

(56) References Cited

U.S. PATENT DOCUMENTS 4,593,260 A * 6/1986 Guero ..... H01H 77/101 335/147
4,743,720 A * 5/1988 Takeuchi ..... H01H 9/302 218/24
5,589,672 A * 12/1996 Uchida ..... H01H 9/362 218/34
5,694,098 A * 12/1997 Mody ..... H01H 77/108 218/22
6,103,986 A * 8/2000 Asakawa ..... H01H 77/108 218/22
6,175,288 B1 * 1/2001 Castonguay ..... H01H 71/2472 218/22
7,772,943 B2 * 8/2010 DeBoer ..... H01H 1/54 335/16
8,461,950 B2 * 6/2013 Lim ..... H01H 33/64 335/126

(Continued)

FOREIGN PATENT DOCUMENTS

JP 2014-102945 A 6/2014
JP 2014-182943 A 9/2014

(Continued)

*Primary Examiner* — Alexander Talpalatski
(74) *Attorney, Agent, or Firm* — Oliff PLC

(57) ABSTRACT

An electromagnetic relay has a contact device and an electromagnet device. An electromagnetic relay has stators which are a pair of rod-like members, and a mover. The mover may face the side of the stator. A housing supports the stator and accommodates the mover. A yoke is fixed to the housing so as to face the movable facing surface and contains a soft magnetic material.

15 Claims, 13 Drawing Sheets

(56) References Cited

U.S. PATENT DOCUMENTS

| | | | | |
|---|---|---|---|---|
| 8,698,582 | B2 * | 4/2014 | Uchida | H01H 1/54 335/147 |
| 9,704,676 | B1 * | 7/2017 | Cardwell | H01H 9/362 |
| 2009/0322454 | A1 | 12/2009 | Tanaka et al. | |

FOREIGN PATENT DOCUMENTS

| | | | |
|---|---|---|---|
| JP | 2015-037051 | A | 2/2015 |
| JP | 5821009 | B2 | 11/2015 |
| JP | 5845467 | B2 | 1/2016 |

* cited by examiner

FIG. 25

| | MODEL | Fx (N) | Fy (N) | Fz (N) |
|---|---|---|---|---|
| CMP | | -32.4 | -0.96 | 63.6 |
| EMB-III | | -34.4 | 1.10 | 28.1 |
| EMB-I | | -35.9 | 0.66 | 26.5 |
| EMB-IV | | -28.6 | 1.66 | 28.0 |

CONTACT DEVICE AND ELECTROMAGNETIC RELAY

CROSS REFERENCE TO RELATED APPLICATION

The present application is based on Japanese Patent Application No. 2018-138621 filed on Jul. 24, 2018, disclosure of which is incorporated herein by reference.

TECHNICAL FIELD

The disclosure in this specification relates to a contact device and an electromagnetic relay.

BACKGROUND

The conventional electromagnetic relay includes a mover (movable contactor) movable in the movable direction and a rod-like stator extending along the movable direction.

SUMMARY

The contact device disclosed herein includes a stator which is a pair of rod-like members, a mover having a movable facing surface opposed to a side surface of a pair of stators, a housing which supports the stator and accommodates the mover, a yoke fixed to the housing so as to oppose the movable facing surface and containing a soft magnetic material.

BRIEF DESCRIPTION OF DRAWINGS

FIG. 25 is a table showing an electromagnetic force acting on the mover.

DETAILED DESCRIPTION

Figure 1:
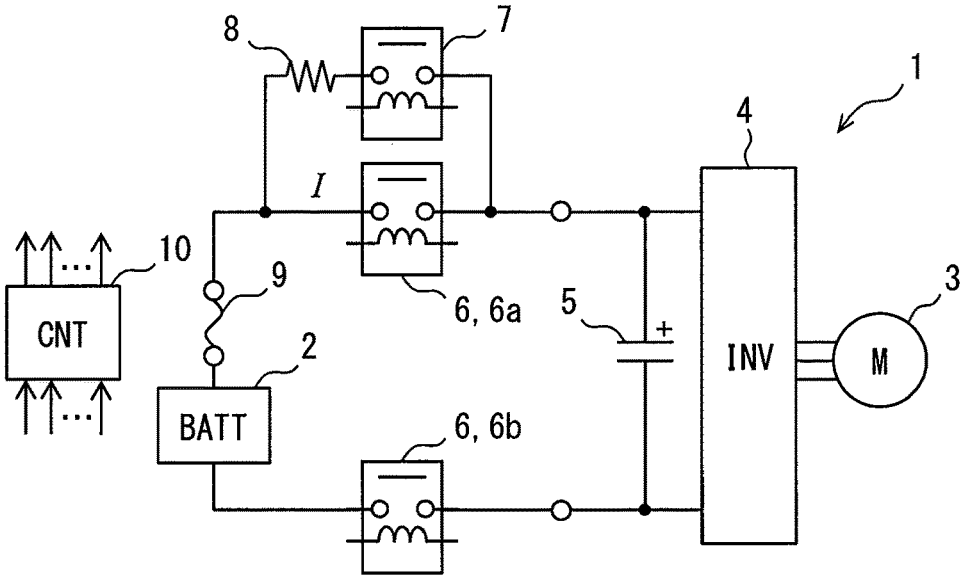
FIG. 1 is a circuit diagram of a power converter according to a first embodiment.

Multiple embodiments will be described with reference to the drawings. In some embodiments, parts that are functionally and/or structurally corresponding to each other and/or associated with each other are given the same reference numerals, or reference numerals with different hundred digit or more digits. For corresponding parts and/or associated parts, additional explanations can be made to the description of other embodiments.

First Embodiment

FIG. 1 shows a power converter 1. The power converter 1 supplies power from a battery 2 to a motor 3. The power converter 1 includes an inverter 4 configured to control voltage, current, and/or frequency of power supplied to the motor 3. The power converter 1 has a smoothing capacitor 5 on the DC input side of an inverter (INV) 4. The power converter 1 has a relay 6 configured to interrupt the circuit. The relay 6 is also referred to as a main relay. The relay 6 has two relays 6*a* and 6*b* provided in a positive side circuit and a negative side circuit. The power converter 1 has a precharge circuit. The precharge circuit is disposed in parallel with one relay 6. The power converter 1 has a relay 7 and a resistor 8 which forms a precharge circuit. The relay 7 and the resistor 8 are connected in series in the precharge circuit. The relays 6 and 7 are electromagnetic relays. The power converter 1 has a fuse 9. The power converter 1 has a controller (CNT) 10. The controller 10 controls relay 6 and relay 7.

The power converter 1 can be used, for example, for an electric vehicle. In this case, the motor 3 is a traveling motor of a vehicle or a traveling generator motor. Moreover, the power converter 1 can be utilized for an air conditioner. In this case, the motor 3 drives a compressor. Moreover, the power converter 1 can be used for various applications. The power converter 1 can also be used for mobile bodies such as vehicles, aircraft, and ships as well as stationary devices such as air conditioners, amusement equipment, video equipment, lighting equipment.

The controller 10 is an electronic control unit (Electronic Control Unit). The controller provides a control system for the power converter. The controller 10 has at least one arithmetic processing unit (CPU) and at least one memory device (MMR) as a storage medium for storing programs and data. The control system is provided by a microcomputer comprising a computer readable storage medium. The storage medium is a non-transitional tangible storage medium that temporarily stores a computer readable program. The storage medium may be provided as a semiconductor memory, a magnetic disk, or the like. The control system may be provided by one computer or a group of computer resources linked via a data communication device.

The program is executed by the control system to cause the control system to function as a device described in the present specification and to cause the control system to function to perform the methods described in the present specification.

Software stored in a tangible memory and a computer executing the software, only the software, only hardware, or combination of them may be possible to provide a method and/or function provided by the control system. For example, the control system can be provided by a logic called if-then-else type, or a neural network tuned by machine learning. For example, if the control system is provided by an electronic circuit that is hardware, the control device may be provided by a digital circuit or an analog circuit that includes a large number of logic circuits.

Figure 2:
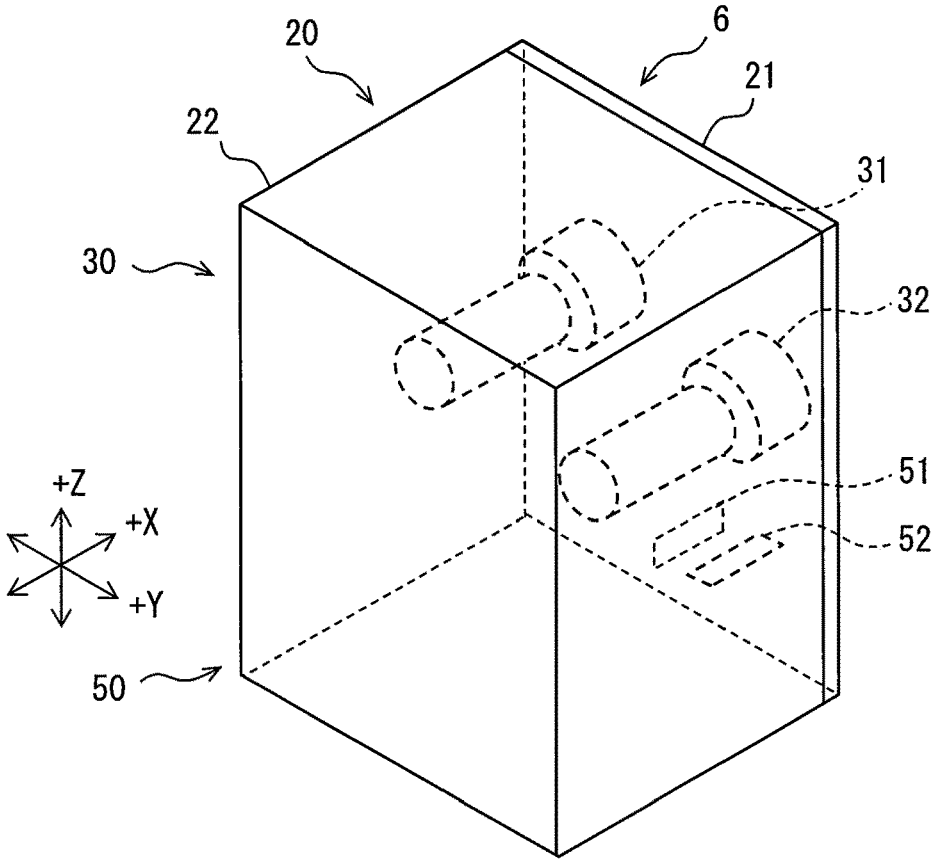
FIG. 2 is a perspective view of a relay according to the first embodiment.

FIG. 2 is a perspective view of the relay 6 according to the first embodiment. The relays 6 and 7 have the same configuration. In the following description, the relay 6 will be representatively described. In the following description, for convenience, a X-axis direction is referred to as the front-rear direction (depth direction), a Y-axis direction as the left-right direction (lateral direction), and a Z-axis direction as the vertical direction (height direction).

The relay 6 has a housing 20. The housing 20 is made of resin. The relay 6 includes the contact device 30 accommodated in the housing 20. The contact device 30 has at least a stator and a mover. Furthermore, the relay 6 includes the electromagnet device 50 accommodated in the housing 20. The electromagnet device 50 moves the mover. The housing 20 has a base 21 and a cover 22. The base 21 constitutes one surface of a rectangular parallelepiped. The cover 22 provides the remaining five sides of the rectangular parallelepiped.

The relay 6 can take various mounting postures in an actual product. The relay 6 can be installed with, for example, the Z-axis direction, the X-axis direction, or the Y-axis direction as a gravity direction. More specifically, −Z direction, +Z direction, −X direction, +X direction, −Y direction, +Y direction can be set as a gravity direction. The illustrated posture is merely illustrated as a typical posture.

The base 21 provides a member that supports the contact device 30 and the electromagnet device 50. The base 21 supports a pair of stators 31 and 32 and a pair of control terminals 51 and 52. The pair of stators 31 and 32, and the pair of control terminals 51 and 52 are provided by a nonmagnetic conductor material. The pair of stators 31 and 32 constitute a power terminal for the contact device 30. The pair of stators 31 and 32 are supported to extend from the base 21 into the housing 20. The pair of stators 31 and 32 are supported in parallel with each other. The arrangement of the pair of stators 31 and 32 contributes to suppress the size of the relay 6 in the Z-axis direction. The pair of control terminals 51 and 52 are terminals for supplying excitation current to the electromagnet device 50. The cover 22 covers the contact device 30 and the electromagnet device 50.

Figure 3:
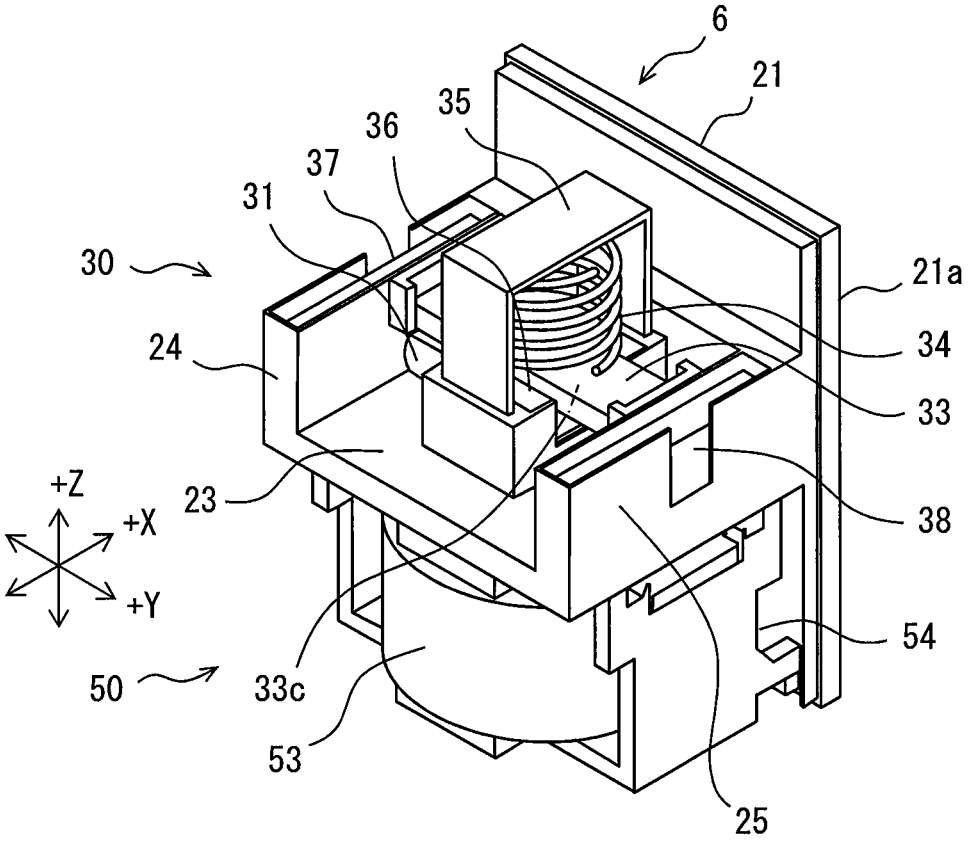
FIG. 3 is a perspective view showing the inside of the relay.

FIG. 3 shows the inside of the relay 6. The base 21 includes a side plate 21*a*. The side plate 21*a* constitutes one of the outer surfaces of a rectangular parallelepiped. The base 21 has an intermediate member 23. The intermediate member 23 is also referred to as an intermediate plate. The intermediate member 23 extends from an intermediate position of the side plate 21*a*. The intermediate member 23 extends from an intermediate position in the movable direction of the mover 33 so as to be orthogonal to the movable direction (Z direction). The intermediate member 23 is a fixed member opposed to a movable facing surface 33*c* described later. The intermediate member 23 is orthogonal to the side plate 21*a*. The intermediate member 23 extends so as to partition the inside of the housing 20. However, the intermediate member 23 is not an airtight partition. The intermediate member 23 divides the inside of the housing 20 into a contact chamber for the contact device 30 and an electromagnet chamber for the electromagnet device 50. The contact device 30 is disposed in the contact chamber. The electromagnet device 50 is disposed in the electromagnet chamber. In other words, the intermediate member 23 is positioned between the contact device 30 and the electromagnet device 50. The intermediate member 23 is also a member that supports the contact device 30 at the top and supports the electromagnet device 50 at the bottom. The intermediate member 23 extends parallel to the stators 31 and 32. The intermediate member 23 is also a support member that supports the stators 31 and 32 directly or indirectly. The intermediate member 23 also extends parallel to the mover 33.

The contact device 30 has the stator 31 and the stator 32. The stator 32 is not shown in this figure. The stators 31 and 32 are also referred to as fixed contacts. The stators 31 and 32 are fixed to the base 21. Specifically, the stators 31 and 32 are disposed to penetrate the side plate 21*a*. The stators 31 and 32 project inwardly from the side plate 21*a*. The stators 31 and 32 extend along the intermediate member 23. The stators 31 and 32 are supported directly or indirectly by the intermediate member 23.

The contact device 30 has a mover 33. The mover 33 is also referred to as a movable contact. The mover 33 is movable relative to the stators 31 and 32. The mover 33 is a member that provides a path for electrically conducting between the stator 31 and the stator 32. The mover 33 is provided by a nonmagnetic conductor material. The mover 33 is a conductor piece that can be called a plate or a rectangular parallelepiped. The mover 33 has a movable facing surface 33*c*. The movable facing surface 33*c* is one surface of the mover 33 facing the stators 31 and 32. The mover 33 is movable to provide opening and closing of the relay 6. The mover 33 is capable for moving to an ON position contacting the stators 31 and 32 and an OFF position separating from the stators 31 and 32. The mover 33 is driven by the electromagnet device 50. The mover 33 and the electromagnet device 50 are operatively connected.

The contact device 30 has a spring 34. The contact device 30 has a holder 35 for holding the spring 34. The spring 34 and the holder 35 are made of nonmagnetic metal material. The holder 35 is fixed to the intermediate member 23. The spring 34 is positioned between the mover 33 and the holder 35 in a compressed state. The spring 34 biases the mover 33 toward the stators 31 and 32. As a result, the mover 33 is biased into contact with the stators 31 and 32. Springs 34 are also referred to as contact springs, contact pressure springs, or back pressure springs.

The contact device 30 has a yoke 36. The yoke 36 comprises a soft magnetic material. The yoke 36 is disposed on a side of the stators 31 and 32 as viewed from the mover 33. The yoke 36 provides a magnetic path for the magnetic field generated around the mover 33 by the current flowing through the mover 33. As a result, the magnetic flux linked to the mover 33 increases. The magnetic flux linked to the mover 33 exerts an electromagnetic force on the mover 33 by the interaction with the current passing through the mover 33. Here, the electromagnetic force acts to bias the mover 33 toward the stators 31 and 32. This electromagnetic force opposes the contact repulsive force acting in the direction of moving the mover 33 away from the stators 31 and 32.

The contact device 30 has permanent magnets 37 and 38 for extinction. An arc may occur between the stators 31 and 32 and the mover 33. The permanent magnets 37 and 38 generate a magnetic field in the arc generation range. In the magnetic field, the arc is electromagnetically stretched. The arc loses heat and disappears by stretching or by contacting the base 21. In this embodiment, a pair of permanent magnets 37 and 38 is disposed outside the pair of stators 31 and 32. Alternatively, the permanent magnets for arcing can be arranged in various ways.

The electromagnet device 50 includes an electromagnetic coil 53 and an electromagnet yoke 54. The electromagnet device 50 operates the mover 33 by a connection member described later.

Figure 4:
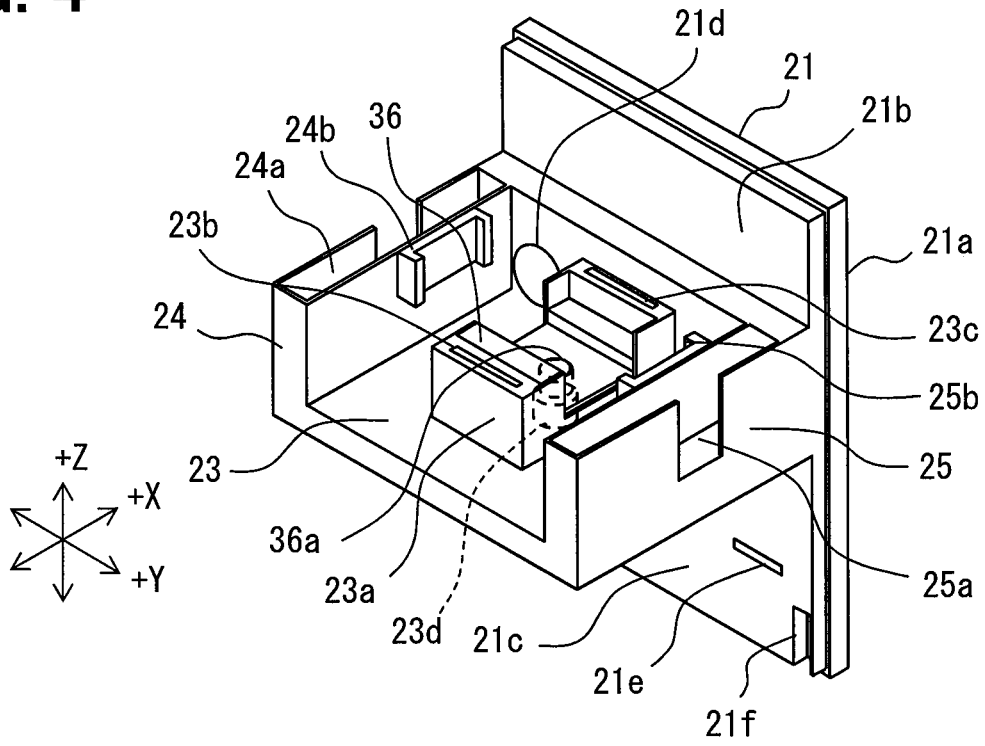
FIG. 4 is a perspective view showing a base.

FIG. 4 shows the base 21. In this figure, the state in which the yoke 36 is fixed to the base 21 is illustrated. The yoke 36 is disposed between the mover 33 and the electromagnet device 50. The yoke 36 has an opening 36*a* for arranging a connecting member described later. The connecting member is a member positioned between the mover 33 and the electromagnet device 50 and operates the mover 33. The opening 36*a* is provided by a through hole. The opening 36*a* may be a slit that opens at the edge of the yoke 36.

The base 21 is a resin molded product. The side plate 21*a* has a first wall 21*b* which extends above the intermediate member 23, i.e, on one side, and a second wall 21*c* which extends below the intermediate member 23, i.e, on the other side. The first wall 21*b* is part of a wall that defines the contact chamber. The second wall 21*c* is a part of the wall that defines the electromagnet chamber. The first wall 21*b* has two through holes 21*d* in such manner that the stators 31 and 32 are passed through. In this figure, one through hole 21*d* is not shown. The second wall 21*c* has two through holes 21*e* for the control terminals 51 and 52. The second wall 21*c* has a plurality of fixing grooves 21*f* for fixing the electromagnet yoke 54.

The base 21 is provided with a yoke fixing portion 23*a* for fixing the yoke 36. The yoke fixing portion 23*a* is integrally formed with the intermediate member 23. The yoke fixing portion 23*a* is used to receive the yoke 36 and to fix the yoke 36. The yoke 36 is stably fixed by the yoke fixing portion 23*a*. The yoke fixing portion 23*a* also contributes to electrically insulate the yoke 36. The yoke fixing portion 23*a* is located between the pair of stators 31 and 32. As a result, the yoke 36 and the stators 31 and 32 are fixed to the same member. This arrangement ensures electrical isolation between the stators 31 and 32. In particular, the decrease in reliability associated with the movable yoke 36 is suppressed. The yoke 36 is supported by the base 21 so as to extend from the base 21. The yoke 36 is supported away from the inner surface of the base 21. The intermediate member 23 includes slots 23*b* and 23*c* for fixing the holder 35. The slots 23*b* and 23*c* are used as a holder fixing portion.

The intermediate member 23 has an opening 23*d* for positioning a connecting member described later. The intermediate member 23 is disposed between the mover 33 and the electromagnet device 50. The intermediate member 23 has an opening 23*d* for disposing the connecting member. The opening 23*d* is provided by a through hole. The opening 23*d* may be provided by a slit that opens at the edge of the intermediate member 23.

The base 21 comprises a pair of cross members 24 and 25. The pair of cross members 24 and 25 are also part of the intermediate member 23. The cross member 24 is stretched to connect the side plate 21*a* and the intermediate member 23. The cross member 25 is stretched so as to connect the side plate 21*a* and the intermediate member 23. The cross members 24 and 25 includes magnet holders 24*a* and 25*a*. The magnet holders 24*a* and 25*a* accommodate and support the arc-extinguishing permanent magnets 37 and 38. The magnet holders 24*a* and 25*a* are formed in a slot shape. The cross members 24 and 25 provide mover guides 24*b* and 25*b*. The mover guides 24*b* and 25*b* contact the mover 33 to restrict the moving range of the mover 33 and guide the mover 33. The mover guides 24*b* and 25*b* allow the mover 33 to move in the vertical direction (Z-axis direction). On the other hand, the mover guides 24*b* and 25*b* restrict the movement of the mover 33 in the front-rear direction (X-axis direction) and the left-right direction (Y-axis direction).

Figure 5:
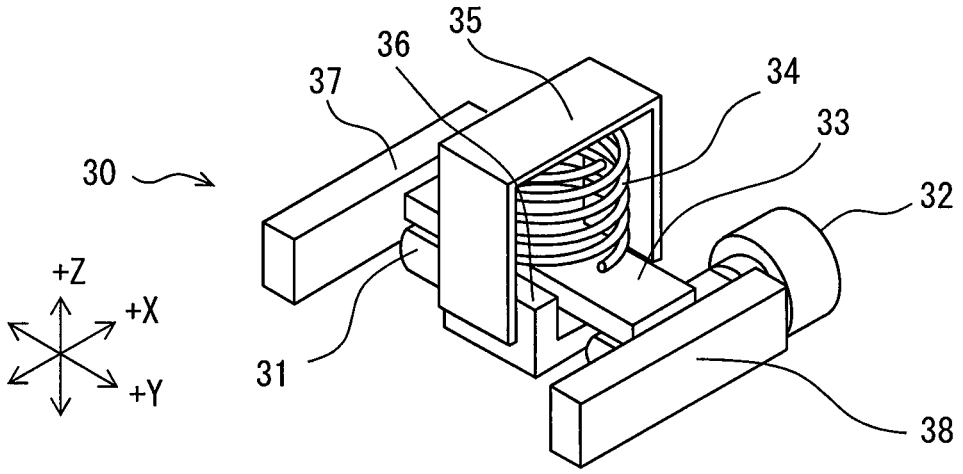
FIG. 5 is a perspective view showing a contact device.

FIG. 5 shows the contact device 30. The contact device 30 includes at least stators 31 and 32 and the mover 33. The contact device 30 may include the spring 34. The contact device 30 may include the yoke 36. The contact device 30 may include permanent magnets 37 and 38 for extinction.

Figure 6:
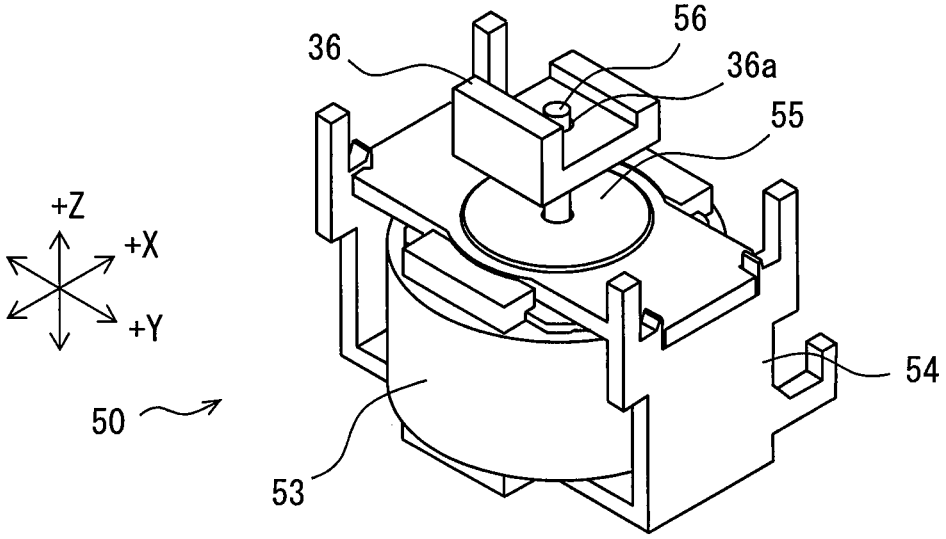
FIG. 6 is a perspective view showing an electromagnet device.

FIG. 6 shows the electromagnet device 50. This figure illustrates the relationship between the yoke 36 and the electromagnet device 50. The electromagnet device 50 has an electromagnetic coil 53, an electromagnet yoke 54, an armature 55, and a connecting member 56. The armature 55 and the connecting member 56 are connected, and the movement of the armature 55 according to the excitation and non-excitation of the electromagnetic coil 53 is output as the displacement of the connecting member 56. The connection member 56 is a rod. The connection member 56 is a nonmagnetic member. The connecting member 56 is provided with a nonconductive member or includes a nonconductive member to provide electrical insulation with the mover 33. The connecting member 56 extends through the yoke 36. The connecting member 56 is positioned at the opening 36*a*. As a result, the yoke 36 does not interlock with the connecting member 56. Thereby, the weight of the movable part is suppressed.

The electromagnet device 50 pushes up the mover 33 against the spring 34 by moving the connecting member 56 upward. As a result, the electromagnet device 50 drives the contact device 30 to the shutoff state (OFF state). The electromagnet device 50 pushes down the mover 33 by the biasing force of the spring 34 by moving the connecting member 56 downward. Thereby, the electromagnet device 50 drives the contact device 30 to the conductive state (ON state).

Figure 7:
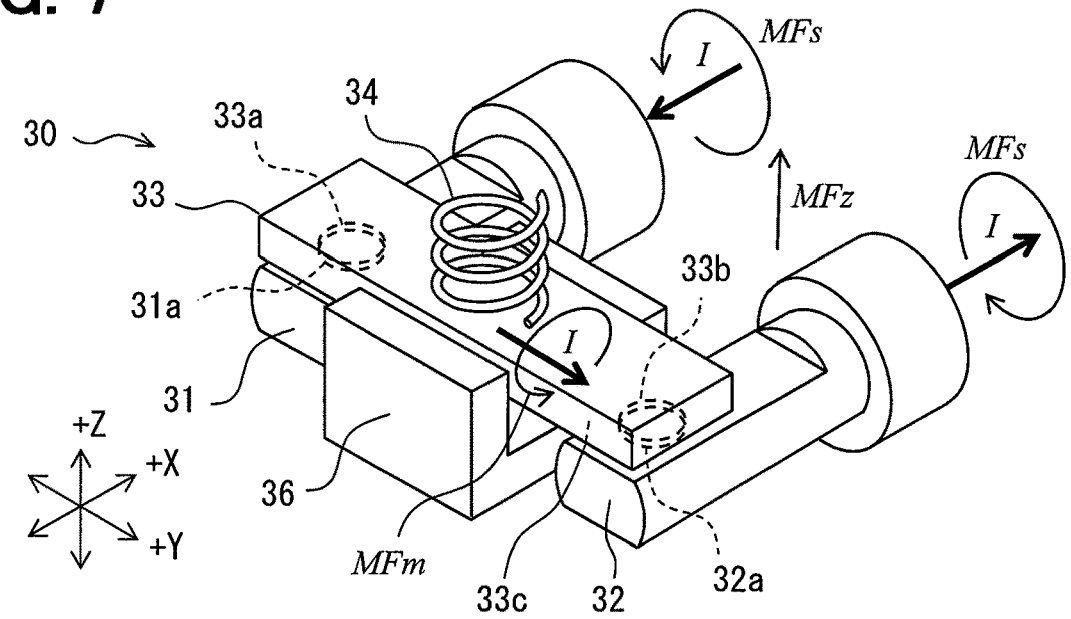
FIG. 7 is a perspective view showing a contact device.

FIG. 7 shows the contact device 30. The mover 33 is movable in the movable direction (Z-axis direction). The stators 31 and 32 extend along an extending direction (X-axis direction) orthogonal to the movable direction (Z-axis direction) of the mover 33. The stators 31 and 32 are rod-like members. The stators 31 and 32 extend in the depth direction (X-axis direction) of the relay 6. The stators 31 and 32 are arranged to receive the mover 33 on their side surfaces. The stators 31 and 32 have flat portions at portions receiving the mover 33. The arrangement of receiving the mover 33 on the side of the stators 31 and 32 contributes to providing a compact contact device and a compact electrical relay. The pair of stators 31 and 32 are spaced apart by a predetermined distance shorter than the length of the mover 33 in the lateral direction (Y direction).

The mover 33 separates from the stators 31 and 32 by compressing the spring 34 so as to provide an OFF state. The mover 33 is biased by the spring 34 and contacts the stators 31 and 32 so as to provide the ON state. The stators 31 and 32 and the mover 33 have fixed contacts and movable contacts in order to suppress contact wear. The stator 31 has a fixed contact 31*a*. The stator 32 has a fixed contact 32*a*.

The mover 33 has movable contacts 33*a* and 33*b*. The movable contacts 33*a* and 33*b* are provided on the movable facing surface 33*c*. The movable facing surface 33*c* is also a surface facing the stators 31 and 32. The movable facing surface 33*c* is a lower surface of the mover 33 in the illustrated example. The yoke 36 is supported by the intermediate member 23 so as to face the movable facing surface 33*c*.

In one aspect, the housing 20 has an intermediate member 23. The intermediate member 23 extends from an intermediate position in the movable direction of the mover 33 so as to be orthogonal to the movable direction (Z direction). The intermediate member 23 is a fixed member opposed to a movable facing surface 33*c* described later.

In another aspect, the housing 20 has a base 21 that extends along the movable direction of the mover 33. The pair of stators 31 and 32 extend from the intermediate position of the base 21 in the movable direction so as to be orthogonal to the movable direction.

The symbol I indicates short circuit current as one example. The symbols MFs, MFz, MFm indicate the directions of the magnetic field and the magnetic flux generated by the current I. It is also possible to assume a short circuit current reverse to the short circuit current shown in FIG. 7. In this case, a person skilled in the art can understand that the directions of the magnetic field and the magnetic flux are reversed and the description in this specification is applicable.

The short circuit current I flows through the stators 31 and 32. At this time, magnetic flux MFs is generated around the stators 31 and 32. As a result, a magnetic flux MFz in the +Z direction is generated between the stators 31 and 32. The magnetic flux MFz interlinks with the mover 33 as well. Due to the interaction between the short circuit current I flowing to the mover 33 and the magnetic flux MFz, an electromagnetic force (also called Lorentz force) in the −X direction acts on the mover 33. That is, the mover 33 receives an electromagnetic force so that the mover 33 is pushed back and forth by the electromagnetic force. In this embodiment, the mover 33 is guided by the mover guides 24*b* and 25*b* so that undesired movement of the mover 33 is prevented.

The mover 33 receives a contact repulsive force due to the short circuit current I. The contact repulsive force often occurs due to current concentration at the fixed contacts 31*a* and 32*a* and the movable contacts 33*a* and 33*b*. The contact repulsive force acts on the mover 33 so as to separate the mover 33 from the stators 31 and 32. In other words, the contact repulsive force acts to open the contact device.

The short circuit current I generates a magnetic flux MFm when flowing through the mover 33. The magnetic flux MFm circulates around the mover 33. The yoke 36 guides the magnetic flux MFm so that the magnetic flux MFm passes through the mover 33 itself. The yoke 36 is a magnetic path member made of a magnetic material having an air gap. The yoke 36 is disposed such that the mover 33 is positioned in the air gap when the mover 33 is in the ON state. As a result, a part of the magnetic flux MFm is linked to the mover 33. Due to the interaction between the short circuit current I flowing in the mover 33 and the magnetic flux MFm, an electromagnetic force (also called Lorentz force) in the −Z direction acts on the mover 33. That is, the mover 33 receives an electromagnetic force against the contact repulsion. This prevents undesired interruptions due to short circuit current I.

Figure 8:
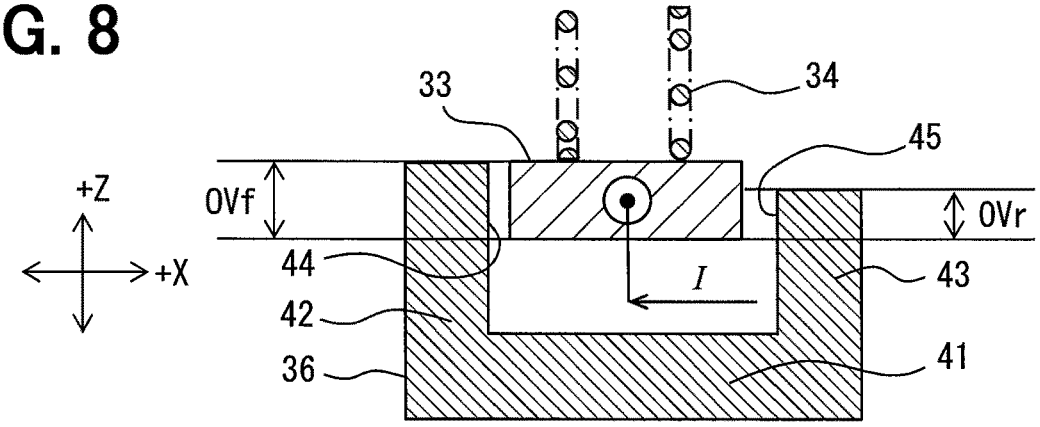
FIG. 8 is a cross-sectional view showing a mover and a yoke.

FIG. 8 shows a cross section of the mover 33 and the yoke 36. The figure shows the position (ON position) of the mover 33 in the ON state. The yoke 36 has a plate-like main member 41 positioned parallel to the mover 33. The yoke 36 has a front member 42 extending from the front end of the main member 41 toward the front end of the mover 33. The yoke 36 has a rear member 43 that extends from the rear end of the main member 41 toward the rear end of the mover 33. The yoke 36 has front and rear members 42 and 43 of different heights on both sides of the mover 33. The yoke 36 has a rear member 43 from which the magnetic flux flows out toward the mover 33. The yoke 36 has a front member 42 through which magnetic flux flows from the mover 33. A height of the rear member 43 is smaller than that of the front member 42. As a result, the yoke 36 has a shape that can be called a bracket type or a C shape. The front member 42 constitutes a front facing surface 44 facing the front end surface of the mover 33. The rear member 43 constitutes a rear facing surface 45 facing the rear end surface of the mover 33.

The yoke 36 includes the mover 33 in the air gap. The amount by which the yoke 36 and the mover 33 overlap on the front side is an overlap amount OVf. The amount by which the yoke 36 and the mover 33 overlap on the rear side is an overlap amount OVr. The overlap amount OVf is larger than the overlap amount OVr. The overlap amount OVf is the maximum amount that the yoke 36 and the mover 33 can overlap. In other words, the overlap amount OVr is smaller than the overlap amount OVf (OVf>OVr). The yoke 36 has different overlap amounts (OVf>OVr) on both sides of the mover 33. The yoke 36 is asymmetrical in the front-rear direction.

The yoke 36 is fixed to the housing 20 so as to face the movable facing surface 33*c*. The yoke 36 is asymmetric along a direction (X-axis direction) orthogonal to the movable direction (Z-axis direction) of the mover 33. The yoke 36 is only one.

Figure 9:
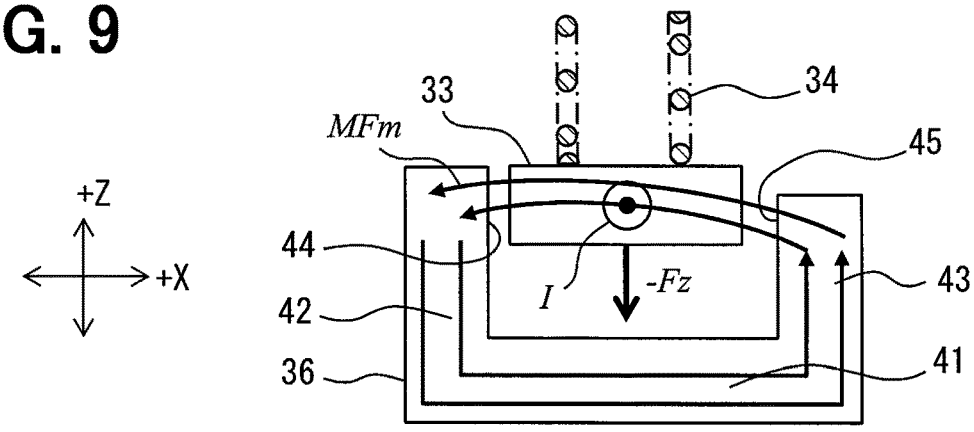
FIG. 9 is a cross-sectional view showing magnetic flux in the mover and the yoke.

FIG. 9 shows the magnetic flux MFm in the mover 33 and the yoke 36. The interaction between the current I and the magnetic flux MFm causes an electromagnetic force −Fz to act on the mover 33. This electromagnetic force −Fz opposes the contact repulsive force. The asymmetrical yoke 36 increases the component of the magnetic flux MFm in the mover 33 in the +Z direction.

Returning to FIG. 4, the mover guides 24*b* and 25*b* restrict the movement of the mover 33 in the extending direction (X-axis direction) of the stators 31 and 32. The mover guides 24*b* and 25*b* stabilize the behavior of the mover 33 when using the mover 33 having the movable facing surface 33*c* facing the side surfaces of the pair of stators 31 and 32. The magnetic flux induced by the current flowing in the stators 31 and 32 exerts an electromagnetic force in the −X direction on the mover 33. The mover guides 24*b* and 25*b* stabilize the behavior of the mover 33 against such an electromagnetic force.

The method of manufacturing the relay 6 (electromagnetic relay) includes the steps of forming the yoke 36 and attaching the yoke 36 to the base 21. At the stage of forming the yoke 36, the yoke 36 is manufactured from an iron-based alloy. The yoke 36 is formed, for example, by cutting and bending a steel plate into a predetermined shape.

At the stage of forming the yoke 36, the yoke 36 is formed asymmetrically. The yoke 36 is formed asymmetrically by adjusting the height of only the rear member 43 among the front member 42 and the rear member 43. In other words, the elements for adjusting the electromagnetic performance caused by the yoke 36 are limited to the height of the rear member 43. For this reason, it is easy to adjust electromagnetic performance. In particular, the height of the rear member 43 directly changes the overlap amount OVr. Therefore, the electromagnetic performance is greatly affected. According to this embodiment, since only the height of the rear member 43 which greatly affects the electromagnetic force acting on the mover 33 is adjusted, effective adjustment is possible.

Returning to FIG. 1, when the short circuit current I flows in the power converter 1, the circuit is interrupted by the relay 6 or the fuse 9. In the case of a relatively small short circuit current I, the circuit is opened by opening the relay 6. At this time, an arc may occur between the contacts. However, a relatively small short circuit current I makes it possible to extinguish. Arc extinguishing is realized by the arc extinguishing device of the relay 6. Specifically, arc-extinguishing permanent magnets 37 and 38 provided in the relay 6 stretch the arc and extinguish the arc. In the case of a relatively large short circuit current I, the circuit is opened since the fuse 9 is blown. Therefore, the relay 6 is required to maintain the closed state over the response time until the fuse 9 is blown. However, an electromagnetic contact repulsive force caused by current concentration acts between the contacts. The contact repulsion may force the mover 33 of the relay 6 to open. In this case, a relatively large short circuit current I generates a strong arc. Therefore, an arc may bridge between the pair of stators 31 and 32, and the relay 6 may be damaged due to the arc.

Therefore, the relay 6 has the role of (1) interrupting the short circuit current and (2) maintaining the closed state until the fuse 9 is melted against the electromagnetic repulsive force. In other words, the relay 6 is required to have the ability to open the circuit by the operation of the relay 6 in the case of a relatively small short circuit current I. On the other hand, relay 6 is required to have the ability to maintain the closed state of relay 6 and wait for mechanical interruption by fuse 9, in the case of relatively large short circuit current I. For automotive applications, for example, in the low short circuit current range of about hundreds of amps to thousands of amps, relay 6 breaks the circuit. On the other hand, in the high short circuit current range which reaches several 1000 A to 10000 A, the relay 6 maintains the on state. However, it is not easy to satisfy the two requirements of the above (1) and (2).

When the relay 6 maintains the on state, it is desirable to apply an electromagnetic force against the contact repulsive force to the mover. In this embodiment, the balance of the magnetic field MFm generated by the current flowing through the mover 33 is changed by providing the yoke 36 to generate an electromagnetic force opposing the contact repulsive force. This electromagnetic force is also called Lorentz force. The yoke 36 interlinks part of the magnetic flux MFm generated by the current of the mover 33 with the mover 33 itself. The interaction between the current flowing to the mover 33 and the magnetic flux causes the electromagnetic force acting on the mover 33 to maintain the mover in the closed state against the contact repulsive force.

Therefore, for relatively large short circuit current I, it is desirable that the electromagnetic force opposing the contact repulsion is large. However, on the other hand, for a relatively small short circuit current I, the electromagnetic force opposing the contact repulsion acts to prevent the relay 6 itself from blocking. In this embodiment, the shape of the yoke 36 is adjusted so as to adjust the electromagnetic force opposing the contact repulsion force, in other words, to adjust it to a predetermined value in advance. Specifically, the yoke 36 is formed asymmetrically in the front-rear direction. The asymmetrical yoke 36 adjusts the angle of the magnetic flux with respect to the mover 33. This configuration provides a relay 6 that is suitable for various applications.

In other words, the yoke 36 is configured to cause the mover 33 to exert an electromagnetic force that opposes the contact repulsion force that causes the mover 33 to open. The yoke 36 applies an electromagnetic force to maintain the mover 33 in the ON state when a current exceeding a threshold (for example, 1000 A) flows through the mover 33. At this time, the mover 33 may be switched from the ON state to the OFF state by the electromagnet device 50, or may be maintained in the ON state. The yoke 36 applies an electromagnetic force that allows the mover 33 to move from the ON state to the OFF state when a current below the threshold flows through the mover 33.

In this embodiment, the relay 6 comprises the intermediate member 23. In addition, the stators 31 and 32 are supported by the intermediate member 23. As a result, the stators 31 and 32, the mover 33, and the yoke 36 can be disposed in a small size. Thus, compact contact device and electromagnetic relay can be provided.

In this embodiment, the yoke 36 is fixed to the base 21 without moving with the mover 33. As a result, movable parts can be reduced. Thus, highly reliable contact device and electromagnetic relay can be provided.

In subsequent embodiments, elements that are the same as or similar to the previous embodiments are given the same reference numerals. The preceding description can be referred to for elements with the same reference numerals.

Second Embodiment

The present embodiment is a modification in which the preceding embodiment is a base fundamental form. In the preceding embodiment, the electromagnet device 50 pushes up the mover 33 by the connecting member 56. Instead of this configuration, the electromagnet device 50 of this embodiment pulls down the mover 33 by the connecting member 56.

Figure 10:
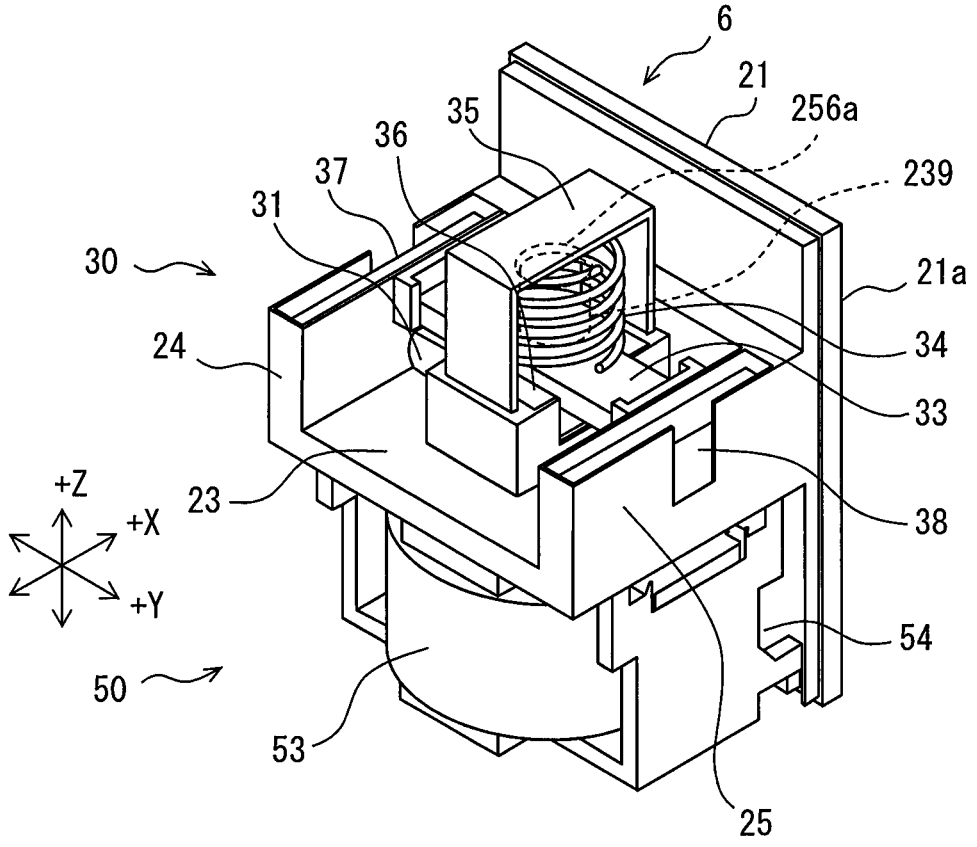
FIG. 10 is a perspective view of a relay according to a second embodiment.

FIG. 10 shows the inside of the relay 6. The relay 6 has a connection mechanism for operatively connecting the mover 33 and the electromagnet device 50. The connection mechanism has a stopper 256*a* and a sub spring 239.

Figure 11:
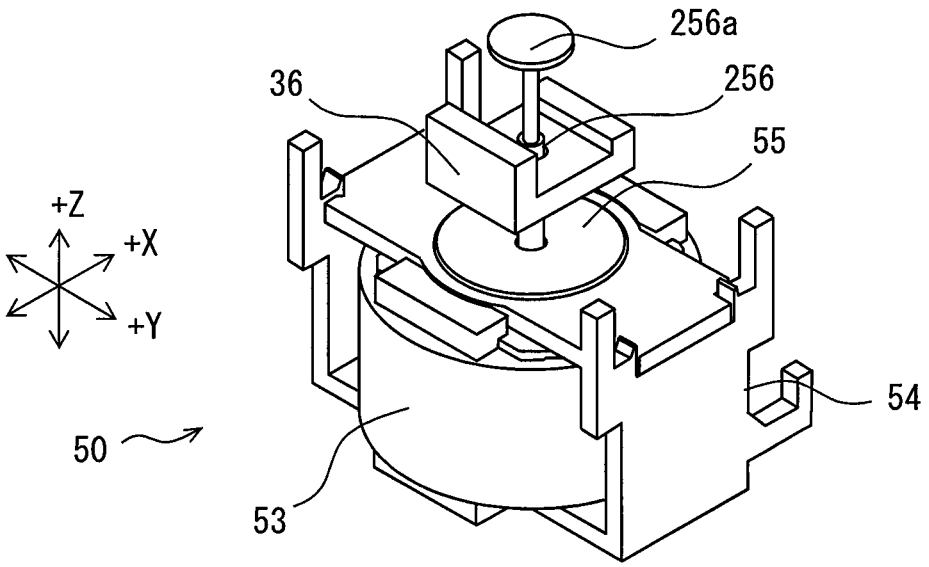
FIG. 11 is a perspective view showing an electromagnet device.

FIG. 11 shows the electromagnet device 50. The connecting member 256 has a thick axis and a thin axis, and has a step between them. The thick shaft extends through the yoke 36. A thin shaft extends through the mover 33. The stepped portion is positioned so as to face the lower surface (movable contact surface) of the mover 33. The stepped portion can contact the mover 33. Also in this embodiment, the connecting member 256 pushes up the mover 33 by the step portion. The connecting member 256 has a stopper 256*a* at its tip.

Figure 12:
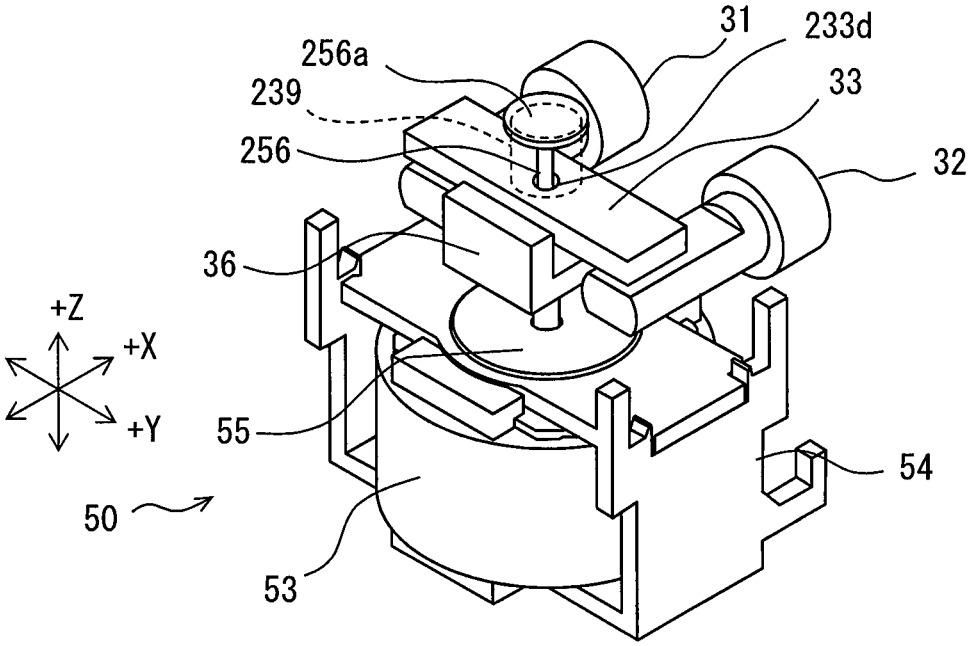
FIG. 12 is a perspective view showing a contact device.

FIG. 12 shows the contact device 30. The mover 33 has an opening 233*d* for disposing the connecting member 256. The opening 233*d* is provided by a through hole. The connecting member 256 extends through the mover 33 and the yoke 36. The stopper 256*a* is positioned above the mover 33. The sub spring 239 is disposed between the stopper 256*a* and the mover 33. In this embodiment, the electromagnet device 50 pulls down the mover 33 by the connecting member 256. The sub spring 239 allows excessive displacement of the connecting member 256 even after the stators 31 and 32 contact the mover 33.

Third Embodiment

The present embodiment is a modification in which the preceding embodiment is a base fundamental form. In the preceding embodiment, the yoke 36 is asymmetrical with respect to the longitudinal direction. Instead, a symmetrical yoke 336 is used in this embodiment.

Figure 13:
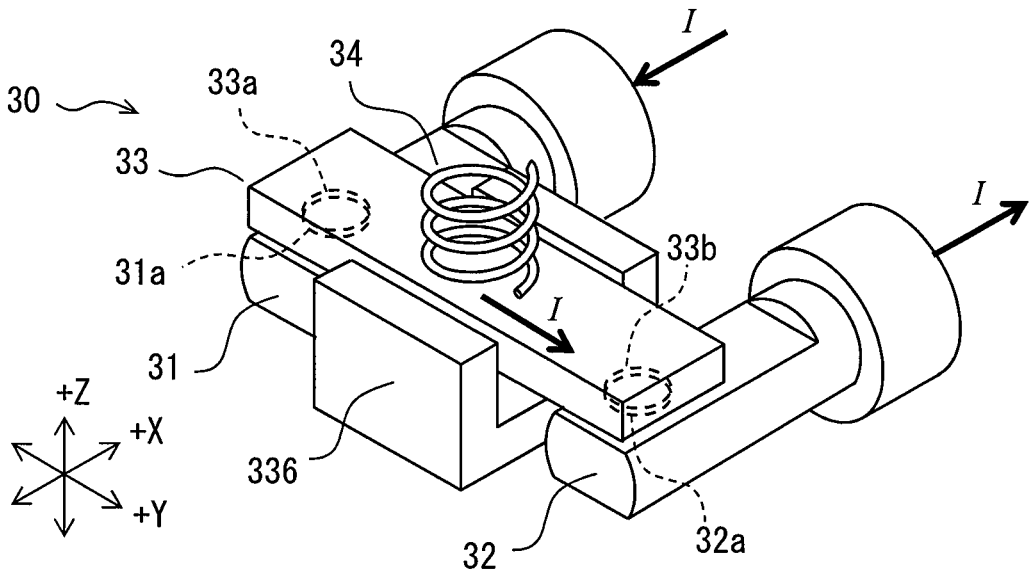
FIG. 13 is a perspective view showing a contact device according to a third embodiment.
Figure 14:
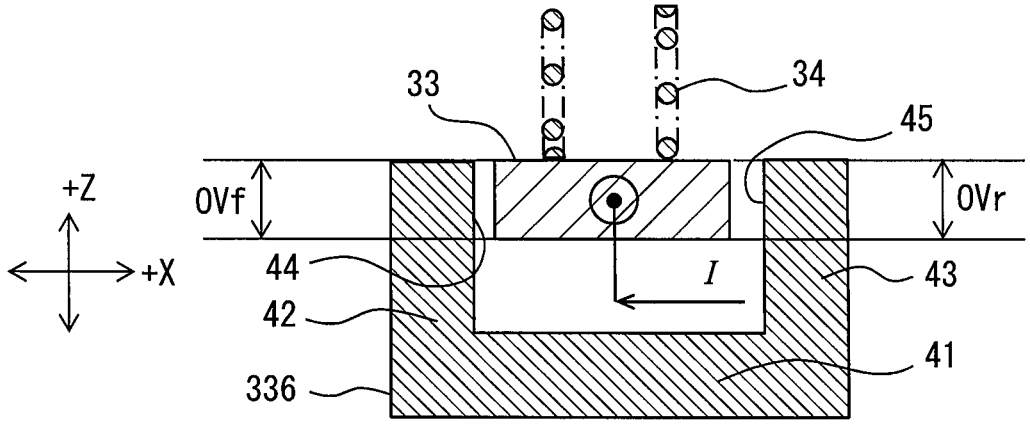
FIG. 14 is a cross-sectional view showing a mover and a yoke.

FIGS. 13 and 14 show the contact device 30. A yoke 336 is used in place of the yoke 36 described above. The overlap amount OVf and the overlap amount OVr are equal (OVf=OVr). In this embodiment, the position of the yoke 336 is adjusted so that the mover 33 can obtain an electromagnetic force necessary to counter the contact repulsion. Also in this embodiment, the same effects as those of the preceding embodiments can be obtained.

Fourth Embodiment

The present embodiment is a modification in which the preceding embodiment is a base fundamental form. In the preceding embodiment, the yoke 36 has a front member 42 higher than the rear member 43. Instead of this configuration, in this embodiment, a yoke 436 has the front member 42 lower than the rear member 43.

Figure 15:
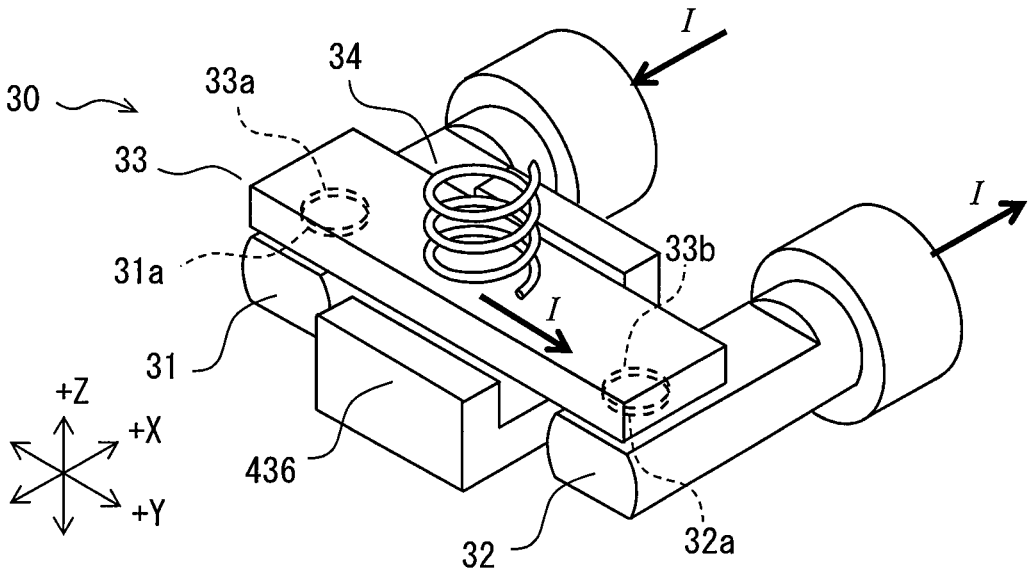
FIG. 15 is a perspective view showing a contact device according to a fourth embodiment.
Figure 16:
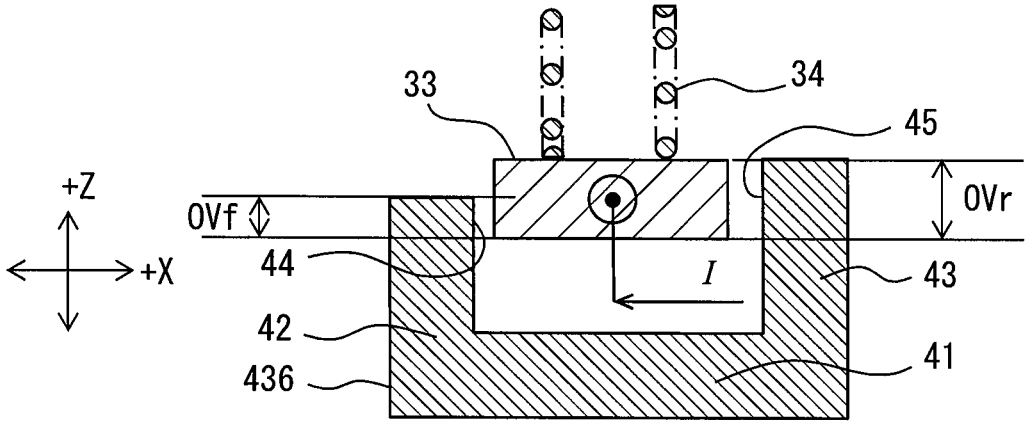
FIG. 16 is a cross-sectional view showing a mover and a yoke.

FIGS. 15 and 16 show the contact device 30. The yoke 436 has front and rear members 42 and 43 having different heights on both sides of the mover 33. The rear member 43 is higher than the front member 42. The overlap amount OVf is smaller than the overlap amount OVr. In other words, the overlap amount OVr is larger than the overlap amount OVf. The yoke 436 also provides different amounts of overlap (OVf<OVr) on both sides of the mover 33. Also in this embodiment, the same effects as those of the preceding embodiments can be obtained.

Fifth Embodiment

The present embodiment is a modification in which the preceding embodiment is a base fundamental form. In the preceding embodiments, square yokes 36, 236, 336, 436 are used. Instead, in this embodiment, the shape of the yoke 5 is arc-like or semi-cylindrical.

Figure 17:
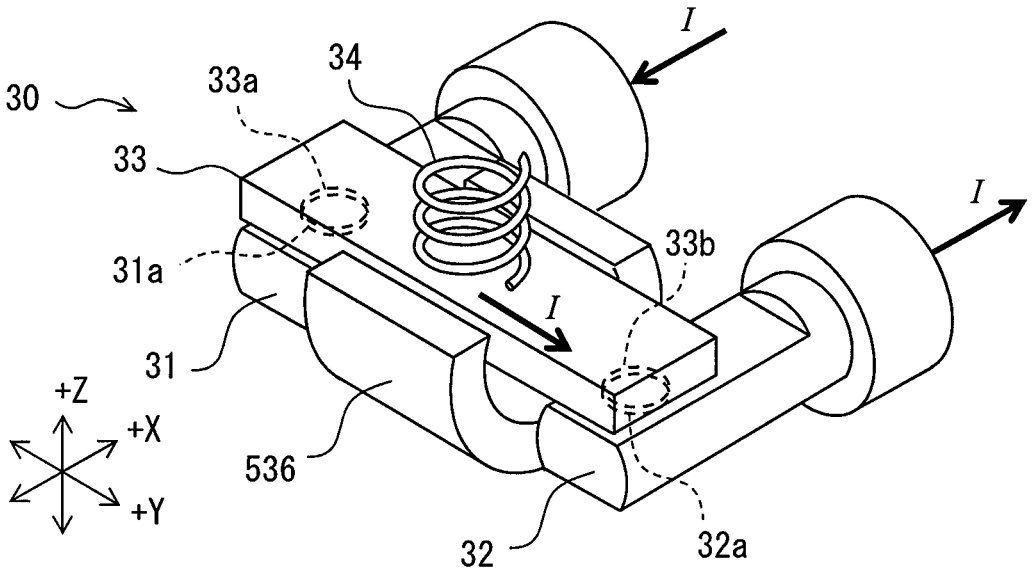
FIG. 17 is a perspective view showing a contact device according to a fifth embodiment.
Figure 18:
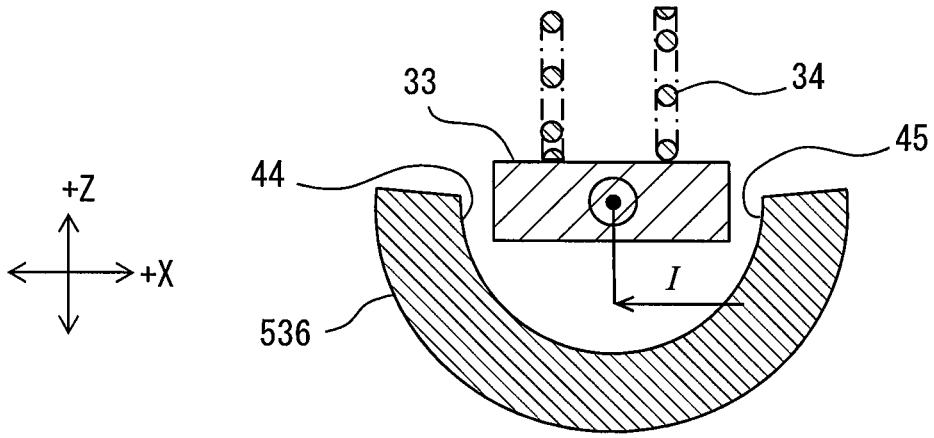
FIG. 18 is a cross-sectional view showing a mover and a yoke.

FIGS. 17 and 18 show the contact device 30. The yoke 536 is semi-cylindrical. The yoke 536 has a front facing surface 44 and a rear facing surface 45. The yoke 536 has an arc-shaped outer side surface 546 and an arc-shaped inner side surface 547. The yoke 536 contributes to efficiently generating an electromagnetic force for countering the contact repulsive force by suppressing the leakage of the magnetic flux. Also in this embodiment, the same effects as those of the preceding embodiments can be obtained.

Sixth Embodiment

The present embodiment is a modification in which the preceding embodiment is a base fundamental form. In the preceding embodiment, in the front-rear direction of the mover 33, both the front facing surface 44 and the rear facing surface 45 are provided. Instead of this configuration, in this embodiment, the yoke 636 has a facing surface only in one of the front and rear.

Figure 19:
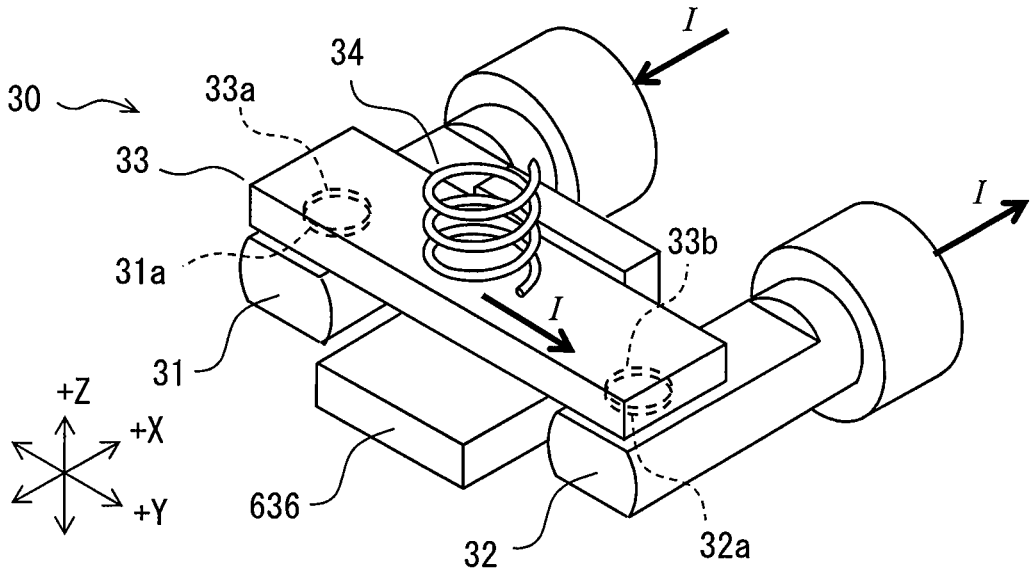
FIG. 19 is a perspective view showing a contact device according to a sixth embodiment.
Figure 20:
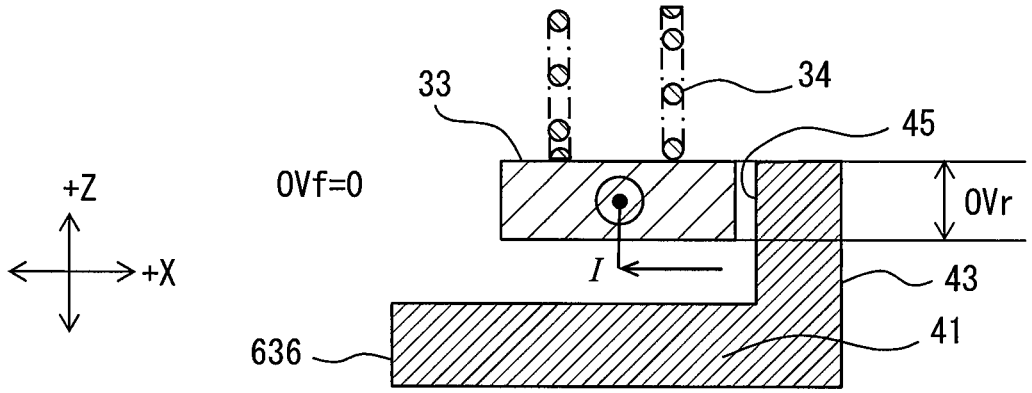
FIG. 20 is a cross-sectional view showing a mover and a yoke.

FIGS. 19 and 20 show the contact device 30. The yoke 636 is L-shaped. The yoke 636 does not have the front facing surface 44. The yoke 636 has only the rear facing surface 45. In this case, the front member 42 is zero height (0). Also in this case, it can be said that the yoke 636 has the front member 42 and the rear member 43 of different heights on both sides of the mover 33. The yoke 636 also provides different amounts of overlap (OVf<OVr) on both sides of the mover 33. The yoke 636 increases the flux component in the −Z direction in front of the mover 33. This configuration contributes to reducing the electromagnetic force acting in the −X direction. Also in this embodiment, the same effects as those of the preceding embodiments can be obtained.

The contact device 30 may employ a yoke different to the yoke 636 illustrated. In this case, the yoke does not have the rear facing surface 45. The yoke 636 has only the front facing surface 44. Also in this embodiment, the same effects as those of the preceding embodiments can be obtained. Thus, the yoke can include at least one of the front facing surface 44 and the rear facing surface 45.

Seventh Embodiment

The present embodiment is a modification in which the preceding embodiment is a base fundamental form. In the preceding embodiment, at least one of the front facing surface 44 and the rear facing surface 45 is provided in the front-rear direction of the mover 33. Instead, in this embodiment, a yoke 736 does not have front and rear facing surfaces.

Figure 21:
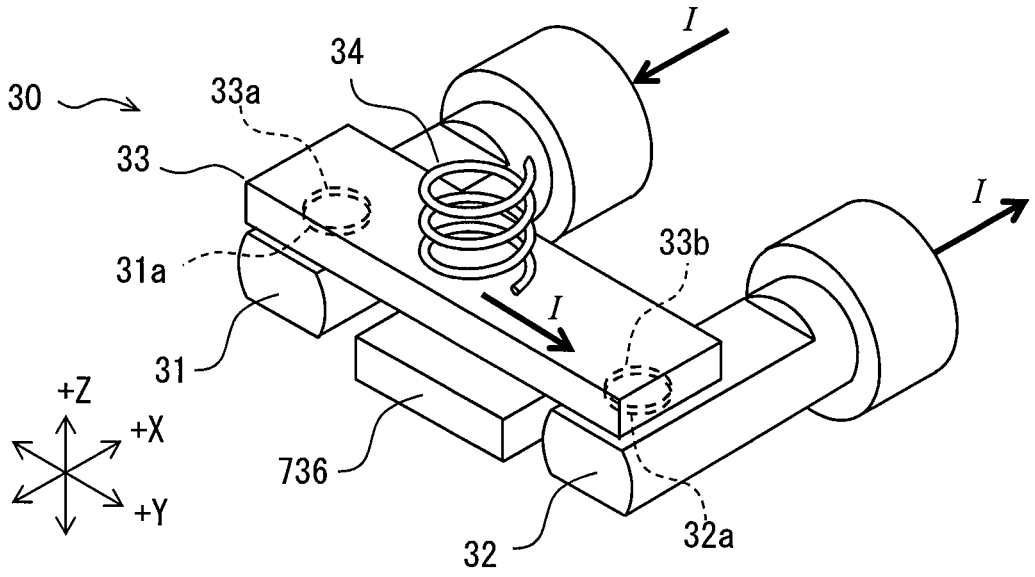
FIG. 21 is a perspective view showing a contact device according to a seventh embodiment.
Figure 22:
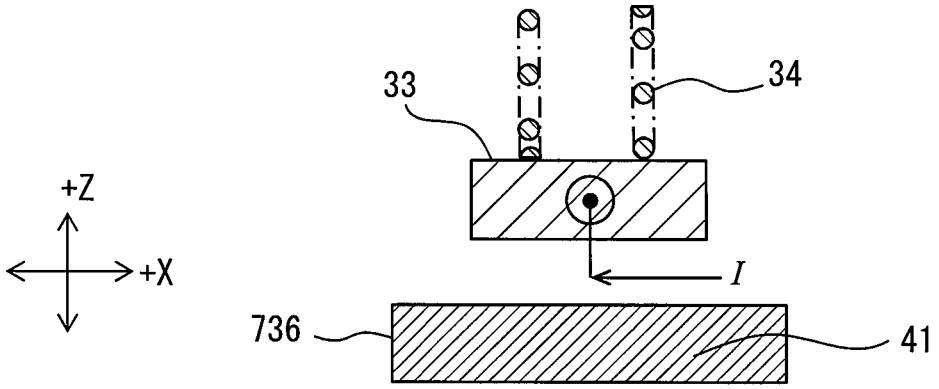
FIG. 22 is a cross-sectional view showing a mover and a yoke.

FIGS. 21 and 22 show the contact device 30. The yoke 736 is in the form of a plate not directly facing the mover 33. The yoke 736 does not have the front facing surface 44. The yoke 736 does not have the rear facing surface 45. The yoke 736 is also a magnetic path member having an air gap. The yoke 736 is arranged to position the mover 33 in the air gap. The yoke 736 may be arranged slightly biased with respect to the mover 33 in the front-rear direction (X-axis direction). For example, the yoke 736 may be positioned so as to protrude only in the front direction (−X direction) with respect to the mover 33 or to protrude only in the rear direction (+X direction) with respect to the mover 33. In these cases, the distribution of the Z-axis direction component in the magnetic flux distribution linked to the mover 33 can be biased. Also in this embodiment, the same effects as those of the preceding embodiments can be obtained.

Eighth Embodiment

The present embodiment is a modification in which the preceding embodiment is a base fundamental form. In the preceding embodiment, the pair of stators 31 and 32 are arranged to extend from the base 21 into the housing 20 in the same direction. Instead of this configuration, in this embodiment, a pair of stators 831 and 832 are used. The pair of stators 831 and 832 are disposed so as to extend from the base 21 into the housing 20 in opposite directions opposite to each other.

Figure 23:
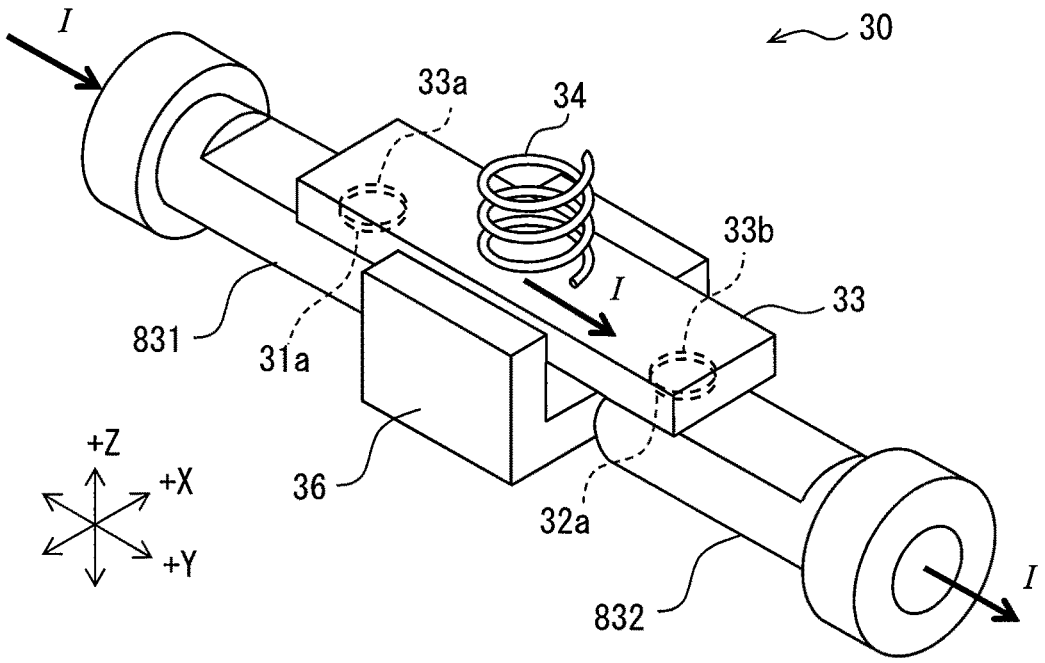
FIG. 23 is a perspective view showing a contact device according to an eighth embodiment.

FIG. 23 shows the contact device 30. Also in this embodiment, the stators 831 and 832 extend through the base 21. The stators 831 and 832 are supported by the intermediate member 23. The pair of stators 831 and 832 are positioned to face each other on both sides of the yoke 36. Also in this embodiment, the same effects as those of the preceding embodiments can be obtained.

Ninth Embodiment

The present embodiment is a modification in which the preceding embodiment is a base fundamental form. In the preceding embodiment, the outer surfaces of the rod-like stators 31, 32, 831 and 832 face the mover 33. Instead of this configuration, in this embodiment, stators 931 and 932 have fixed contacts 31*a* and 32*a* on the tip surface.

Figure 24:
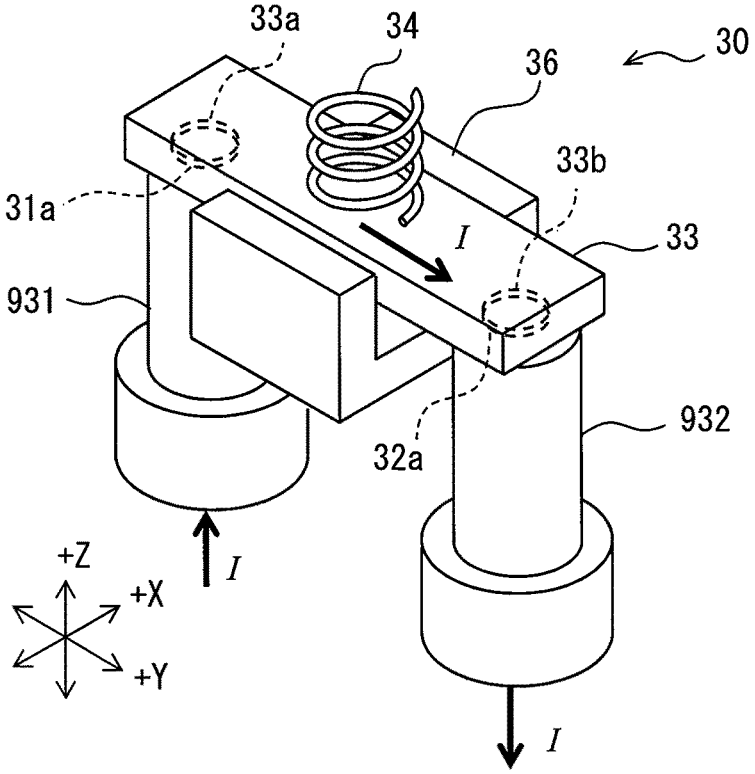
FIG. 24 is a perspective view showing a contact device according to a ninth embodiment.

FIG. 24 shows the contact device 30. The pair of stators 931 and 932 are disposed along the vertical direction. The pair of stators 931 and 932 have fixed contacts 31*a* and 32*a* on the tip surfaces. In this case, the movable direction (Z-axis direction) of the mover 33 coincides with the extending direction (Z-axis direction) of the pair of stators 931 and 932. Also in this embodiment, the same effects as those of the preceding embodiments can be obtained.

Comparative Example (Referred to as CMP)

FIG. 25 shows the result of examining the electromagnetic force acting on the mover 33 for each shape of the yoke. In our study, the force acting on the mover 33 is obtained by calculation under the predetermined short circuit current I (about 10000 A) and the magnetic flux distribution assumed in the yoke of each embodiment. CMP shows a comparative example which does not have a yoke. EMB-III shows the case of the yoke 336 of the third embodiment. EMB-I shows the case of the yoke 36 of the first embodiment. EMB-IV shows the case of the yoke 436 of the fourth embodiment. MODEL schematically shows the shape of the yoke in each embodiment. Fx, Fy, and Fz indicate forces (N) acting on the mover 33.

In the case (CMP) in which there is no yoke, the mover 33 receives a force Fx of −32.4 (N) moving in the forward direction (−X direction). This is a push power caused by the magnetic flux MFz generated in the pair of stators 31 and 32. In the case (CMP) in which there is no yoke, the lateral direction (Y-direction) force Fy is almost negligible. In the case (CMP) in which there is no yoke, the mover 33 receives a force Fz of 63.6 (N) in the upward direction (+Z direction). This force Fz is mostly attributable to contact repulsion.

(EMB-III)

In the case of the third embodiment, the mover 33 receives a force Fx (−34.4 (N)) in the forward direction (−X direction) substantially at the same level as the comparative example (CMP). In the case of the third embodiment, the force Fy in the lateral direction (Y direction) is almost negligible. In the case of the third embodiment, the mover 33 receives a force Fz of 28.1 (N) in the upward direction (+Z direction). The force Fz is significantly suppressed because the electromagnetic force (Lorentz force) generated in the mover 33 is opposed to the contact repulsive force due to the yoke 36.

(EMB-I)

In the case of the first embodiment, the mover 33 receives a force Fx (−35.9 (N)) in the forward direction (−X direction) substantially at the same level as the comparative example (CMP). In the case of the first embodiment, the force Fy in the lateral direction (Y direction) is almost negligible. In the case of the first embodiment, the mover 33 receives a force Fz of 26.5 (N) in the upward direction (+Z direction). In this case, the force Fz is significantly suppressed because the electromagnetic force (Lorentz force) generated in the mover 33 is opposed to the contact repulsive force due to the yoke 36. Moreover, the force Fz is most notably suppressed in this embodiment.

(EMB-IV)

In the case of the fourth embodiment, the mover 33 receives a force Fx (−28.6 (N)) in the forward direction (−X direction) substantially at the same level as the comparative example (CMP). Moreover, the force Fx is most remarkably suppressed in this embodiment. In other words, the thrust force in the front-rear direction is suppressed. This is because a force that opposes the push power caused by the magnetic flux MFz is generated by the yoke 436. In the case of the fourth embodiment, the force Fy in the lateral direction (Y direction) is almost negligible. In the case of the fourth embodiment, the mover 33 receives a force Fz of 28.0 (N) in the upward direction (+Z direction). In this case, the force Fz is significantly suppressed because the electromagnetic force (Lorentz force) generated in the mover 33 is opposed to the contact repulsive force due to the yoke 36.

Other Embodiments

The disclosure in this specification, the drawings, and the like is not limited to the illustrated embodiments. The disclosure encompasses the illustrated embodiments and variations thereof by those skilled in the art. For example, the disclosure is not limited to the combinations of components and/or elements shown in the embodiments. The disclosure may be implemented in various combinations. The disclosure may have additional portions that may be added to the embodiments. The disclosure encompasses omission of components and/or elements of the embodiments. The disclosure encompasses the replacement or combination of components and/or elements between one embodiment and another. The disclosed technical scope is not limited to the description of the embodiments. The several technical ranges disclosed are indicated by the description of the claims, and should be construed to include all modifications within the meaning and range equivalent to the description of the claims.

The disclosure in the specification, drawings and the like is not limited by the description of the claims. The disclosures in the specification, the drawings, and the like encompass the technical ideas described in the claims, and further extend to a wider variety of technical ideas than those in the claims. Therefore, various technical ideas can be extracted from the disclosure of the specification, the drawings and the like without being limited to the description of the claims.

In the above embodiment, the yoke is linked to the magnetic flux by the yoke to generate an electromagnetic force opposing the contact repulsion. In addition to this configuration, a plurality of yokes may be attracted to each other by the magnetic flux generated by the mover, and a force opposing the contact repulsion may be exerted on the mover.

In the above embodiment, the yoke 36 links the magnetic flux generated by the current flowing to the mover 33 to the mover 33 itself. Alternatively, magnetic flux supplied from another magnetic source may be linked to the mover 33. For example, the flux of a permanent magnet or the flux of an electromagnet can be used.

The relays 6 and 7 may be a normally open type in which the circuit is closed by exciting or a normally closed type in which the circuit is opened by exciting. The relays 6 and 7 may provide a biasing force (a basic pressing force for pressing) which biases the mover 33 toward the stators 31 and 32 by the spring 34 alone.

Alternatively, the relays 6 and 7 may bias the mover 33 toward the stators 31 and 32 by balancing the biasing force of the spring 34 and the biasing force of the electromagnet device 50. Furthermore, the relays 6 and 7 may bias the mover 33 toward the stators 31 and 32 only by the biasing force of the electromagnet device 50 without providing the spring 34.

The relays 6 and 7 may contain a gas to promote arcing. The promotion of arcing contributes to increase the upper limit value of the maximum short circuit current which may allow the mover 33 to shut off the circuit. Also, the housing 20, the base 21 and the cover 22 can be provided by known materials such as resin and ceramics.

The contents of the literatures listed as Patent Document 1 (Japanese Patent No. 5206157) and Patent Document 2

(Japanese Patent No. 5821009) are incorporated by reference as an explanation of technical elements in this specification.

In the assumable example, the contact device and the electromagnetic relay are long along the movable direction due to the rod-like stator extending along the movable direction of the mover. This shape has a large size in the movable direction. In addition, this shape may restrict the arrangement of the contact device and the electromagnetic relay in the circuit.

In another aspect, in the assumable example, at least one yoke moves with the mover. A movable yoke is needed. Due to this structure, the contact device becomes complicated and the reliability is reduced. In another aspect, this structure may limit the electromagnetic force to counter the contact repulsion.

In another point of view, in the assumable example, it may be difficult to precisely adjust the electromagnetic force for countering the contact repulsion. For example, in the case where a large short circuit current, which is difficult to extinguish, flows, it is desirable to maintain the closed state against the contact repulsion. On the other hand, in the case where a relatively small short-circuit current with a level easy to extinguish is flowing, it may be desirable to make the mover open.

Further improvements are required for the contact device and the electromagnetic relay in the above-mentioned point of view, or in other aspects not mentioned.

The present disclosure provides a compact contact device and a compact electromagnetic relay.

The present disclosure provides a reliable contact device and electromagnetic relay.

The present disclosure provides a contact device and an electromagnetic relay capable of highly accurate adjustment.

The contact device disclosed herein includes a stator which is a pair of rod-like members, a mover having a movable facing surface opposed to a side surface of a pair of stators, a housing which supports the stator and accommodates the mover, a yoke fixed to the housing so as to oppose the movable facing surface and containing a soft magnetic material.

According to the disclosed contact device, the yoke links the magnetic flux with the mover itself. The mover receives an electromagnetic force that opposes the contact repulsive force by the interaction between the current and the magnetic flux. Thereby, the opening of the mover due to the contact repulsive force is suppressed. The yoke is fixed to the housing. Even if there is a magnetic field caused by the stator, the yoke exerts an electromagnetic force on the mover against the contact repulsive force by the magnetic field caused by the mover.

The contact device disclosed herein includes a pair of stators and a mover having a movable facing surface facing the pair of stators, a housing configured to support the stator and accommodating the mover, and a yoke fixed to the housing so as to face the movable facing surface. The yoke is asymmetric along a direction orthogonal to the moveable direction of the mover and contains a soft magnetic material.

According to the disclosed contact device, the yoke links the magnetic flux with the mover itself. The mover receives an electromagnetic force that opposes the contact repulsive force by the interaction between the current and the magnetic flux. Thereby, the opening of the mover due to the contact repulsive force is suppressed. The yoke is asymmetric along a direction orthogonal to the movable direction. Asymmetrical yokes allow for highly precise adjustments not available with symmetrical shapes.

The contact device disclosed herein includes a mover having a pair of stators, a movable facing surface facing the stator, and a mover, a base having a fixed intermediate member opposed to the movable facing surface, and a yoke supported by an intermediate member facing the movable facing surface. The yoke contains a soft magnetic material.

According to the disclosed contact device, the yoke links the magnetic flux with the mover itself. The mover receives an electromagnetic force that opposes the contact repulsive force by the interaction between the current and the magnetic flux. Thereby, the opening of the mover due to the contact repulsive force is suppressed. The yoke is supported by the intermediate member. For this reason, the size in the movable direction of the mover is suppressed.

The disclosed electromagnetic relay includes the contact device and an electromagnet device for moving the mover, an intermediate member is disposed between the mover and the electromagnet device, and the intermediate member has an opening for arranging a connecting member positioned between the mover and the electromagnet device.

According to the disclosed electromagnetic relay, an intermediate member can be disposed between the contact device and the electromagnet device.

The disclosed electromagnetic relay includes the contact device and an electromagnet device for moving the mover. The yoke is disposed between the mover and the electromagnet device. The yoke has an opening for arranging a connecting member positioned between the element and the electromagnet device.

According to the disclosed electromagnetic relay, an intermediate member can be disposed between the contact device and the electromagnet device.

The disclosed aspects in this specification adopt different technical solutions from each other in order to achieve their respective objectives.

What is claimed is:

1. A contact device, comprising:

a stator comprising a pair of spaced and parallel rod-shaped members with parallel longitudinal axes;

a mover having a stator facing surface facing a side surface of each of the pair of rod-shaped members;

a housing configured to support the stator and house the mover; and a yoke (1) fixed to the housing, (2) having a facing surface that faces the stator facing surface of the mover and (3) containing a soft magnetic material, wherein the yoke (1) is asymmetrical in a direction parallel to the longitudinal axes of the pair of rod-shaped members and (2) is between the pair of rod-shaped members in a direction perpendicular to the longitudinal axes, and the yoke and the mover are configured such that the yoke provides a magnetic path for a magnetic field generated around the mover by current flowing through the mover.

2. The contact device according to claim 1, wherein the housing has a mover guide configured to restrict movement of the mover in the directional parallel to the longitudinal axes.

3. A contact device, comprising:

a pair of stators having parallel longitudinal axes;

a mover having a stator facing surface facing the pair of stators;

a housing configured to support the pair of stators and house the mover; and a yoke (1) fixed to the housing and (2) having a facing surface that faces the stator facing surface, wherein the yoke (1) is asymmetrical when viewed in a direction perpendicular to a movable direction of the mover and perpendicular to the longitudinal axes, (2) contains a soft magnetic material, and (3) is between the pair of stators, and the yoke and the mover are configured such that the yoke provides a magnetic path for a magnetic field generated around the mover by current flowing through the mover.

4. The contact device according to claim 1, wherein, the housing has a base extending along the movable direction of the mover, and the pair of rod-shaped members extend from an intermediate position of the base in the movable direction so as to be orthogonal to the movable direction.

5. The contact device according to claim 1, wherein, the housing has a fixed intermediate member (1) opposed to the stator facing surface and (2) extending in the movable direction of the mover so as to be orthogonal to the movable direction.

6. A contact device, comprising:

a pair of stators having parallel longitudinal axes;

a mover having a stator facing surface facing the pair of stators;

a base having a fixed intermediate member opposed to the facing surface and extending from an intermediate position of the base in a movable direction of the mover so as to be orthogonal to the movable direction; and a yoke (1) supported by the intermediate member, (2) having a facing surface that faces the stator facing surface and (3) containing a soft magnetic material, wherein the yoke (1) is asymmetrical when viewed in a direction perpendicular to a movable direction of the mover and perpendicular to the longitudinal axes and (2) is between the pair of stators, and the yoke and the mover are configured such that the yoke provides a magnetic path for a magnetic field generated around the mover by current flowing through the mover.

7. The contact device according to claim 1, wherein the yoke is configured to apply:

an electromagnetic force to the mover that maintains the mover in an ON state when a current exceeding a threshold flows in the mover, and an electromagnetic force that allows movement of the mover from the ON state to the OFF state when a current below the threshold flows in the mover.

8. The contact device according to claim 1, further comprising, a spring configured to bias the mover toward the stator.

9. The contact device according to claim 1, wherein the yoke has magnetic path members with an air gap between the magnetic path members; and the mover is in the air gap.

10. The contact device according to claim 9, wherein the yoke has a front wall on a first side of the mover in the direction perpendicular to the longitudinal axes of the pair of rod-shaped members and a rear wall on a second side of the mover in the direction perpendicular to the longitudinal axes, and the front wall and the rear wall have different heights.

11. The contact device according to claim 10, wherein the yoke and the mover are configured such that magnetic flux flows from the mover into the front wall and the magnetic flux flows from the rear wall to the mover, and the height of the rear member is lower than the height of the front member.

12. The contact device according to claim 10, wherein the yoke and the mover are configured such that magnetic flux flows from the mover to the front wall and the magnetic flux flows from the rear wall toward the mover, and the height of the rear member is higher than the height of the front member.

13. The contact device according to claim 1, wherein the yoke and the stator are fixed to a same member.

14. An electromagnetic relay, comprising:

a contact device according to claim 6;

an electromagnet device configured to move the mover;

an intermediate member between the mover and the electromagnet device; and a connecting member that connects the mover and the electromagnet device and passes through an opening in the intermediate member.

15. An electromagnetic relay, comprising:

a contact device according to claim 1;

an electromagnet device configured to move the mover; and a connecting member that connects the mover and the electromagnet device, wherein:

the yoke is between the mover and the electromagnetic device; and the connecting member passes through an opening in the yoke.

* * * * *